United States Patent [19]

Agardi

[11] Patent Number: 5,027,958

[45] Date of Patent: Jul. 2, 1991

[54] ELECTRICALLY OPERATED SINGLE CORD CLOTHESLINE

[76] Inventor: Paul Agardi, 571, Terrasse de la Loire, Ville Lasalle, Quebec, Canada, H8R 2Y2

[21] Appl. No.: 564,348

[22] Filed: Aug. 8, 1990

[30] Foreign Application Priority Data

Jun. 21, 1990 [CA] Canada ..... 2019478

[51] Int. Cl.[5] ..... A47F 5/00

[52] U.S. Cl. ..... 211/119.1; 211/119.16; 211/1.5

[58] Field of Search ..... 211/119.1, 119.01, 119.15, 211/119.16, 1.5

[56] References Cited

U.S. PATENT DOCUMENTS

| | | | |
|---|---|---|---|
| 680,320 | 8/1901 | Elliott . | |
| 751,265 | 2/1904 | Crossley . | |
| 1,371,563 | 3/1921 | Le Compte . | |
| 1,979,627 | 11/1934 | Kozak | 68/3 |
| 3,193,212 | 7/1965 | Lotta | 242/107 |
| 4,062,146 | 12/1977 | Grossman et al. | 47/17 |
| 4,775,039 | 10/1988 | Sunakawa | 192/0.02 R |

FOREIGN PATENT DOCUMENTS

| | | | |
|---|---|---|---|
| 1119868 | 7/1968 | United Kingdom | 211/119.16 |

*Primary Examiner*—Robert W. Gibson, Jr.
*Attorney, Agent, or Firm*—Longacre & White

[57] ABSTRACT

The invention relates to an electrically operated single cord clothesline comprising near and distant reel assemblies both attachable to a clothesline supporting structure. The cord encloses individually insulated electric wires, and the near reel assembly includes a reel on which the near end of the cord is wound and a reversible electric motor for driving the latter reel. The distant reel assembly comprises a second reel on which the distant end of the cord is wound and a second reversible electric motor for driving this second reel. A foot control supplies the two reversible motors with electric current to move the cord longitudinally in either direction. The distant motor is obviously supplied through the wires of the cord. The clothesline also incorporates a system for controlling the tension in the cord.

11 Claims, 5 Drawing Sheets

ELECTRICALLY OPERATED SINGLE CORD CLOTHESLINE

BACKGROUND OF THE INVENTION

1. Field of the invention

The present invention relates to an electrically operated single cord clothesline comprising a pair of end reals on which the cord is wound. Each reel is driven by means of a reversible electric motor and the cord encloses electric wires through which electric current is supplied to the distant motor.

2. Brief description of the prior art

Most of the clotheslines presently available on the market comprise a cord forming a closed loop. The latter cord is usually mounted onto a pair of end pulleys.

A first drawback of these prior art clotheslines is that the clothes often wrap and twist around the upper half of the cord. Another drawback is that the known clotheslines are operated manually by pulling or pushing the cord; this is often difficult to accomplish in particular for elderly and disabled persons when the line is full of clothes.

OBJECTS OF THE INVENTION

An object of the invention is therefore to eliminate the above discussed drawbacks of the prior art.

Another object of the present invention is to provide a single cord clothesline which is electrically operated through a foot control.

SUMMARY OF THE INVENTION

More specifically, the present invention relates to an electrically operated clothesline comprising (a) a single cord on which clothes can be hung, which cord having first and second ends and enclosing individually insulated electric wires, (b) a near reel assembly attachable to a first clothesline supporting structure, and including a first reel on which the first end of the cord is wound and a first reversible electric motor for driving this first reel, (c) a distant reel assembly also attachable to a second clothesline supporting structure, and including a second reel on which the second end of the cord is wound and a second reversible electric motor for driving the second reel, and (d) supply means for supplying the first and second reversible motors with electric current to move the cord longitudinally in either direction, the second motor being supplied with electric current through the wires enclosed in the cord.

A system for controlling the tension in the cord is advantageously incorporated in the clothesline in accordance with the present invention.

As the clothesline of the invention is electrically operated, it can be used without effort by anybody. It comprises a single cord whereby the wrapping and twisting problem of the conventional clotheslines is eliminated.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

Figure 1:
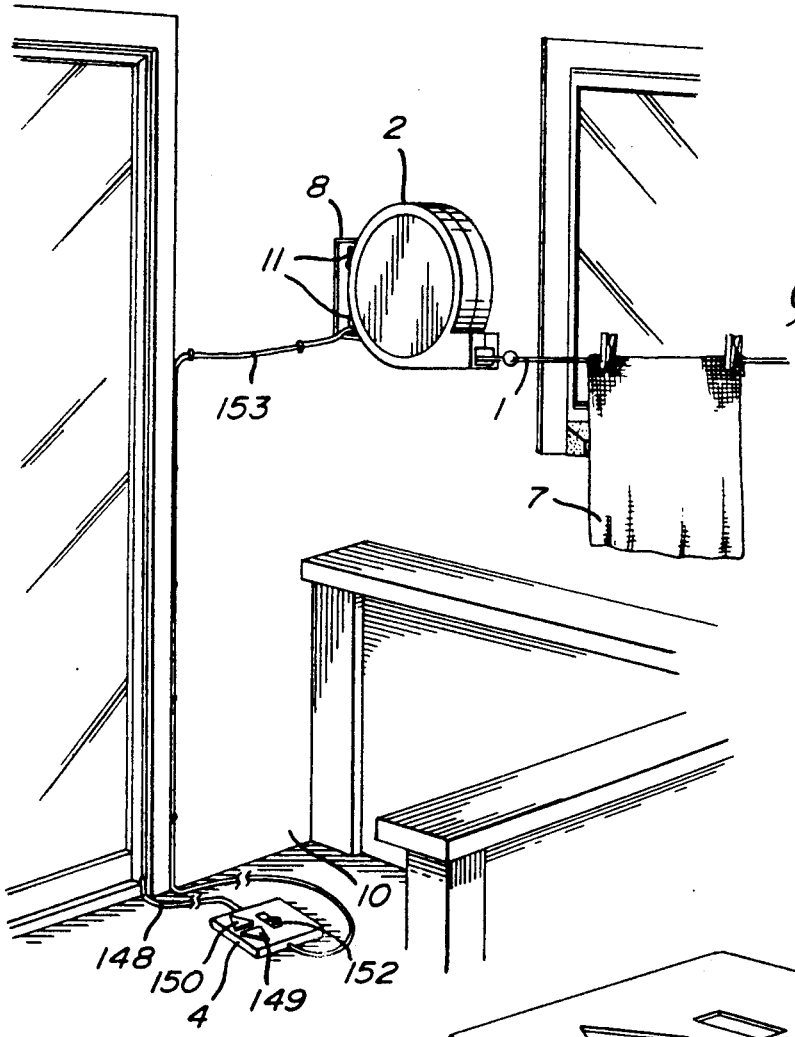
FIG. 1 is a perspective view showing (a) the near reel assembly of a clothesline according to the invention, which assembly is attached to the outside wall of a house, and (b) a foot control for moving the cord longitudinally in either direction.
Figure 2:
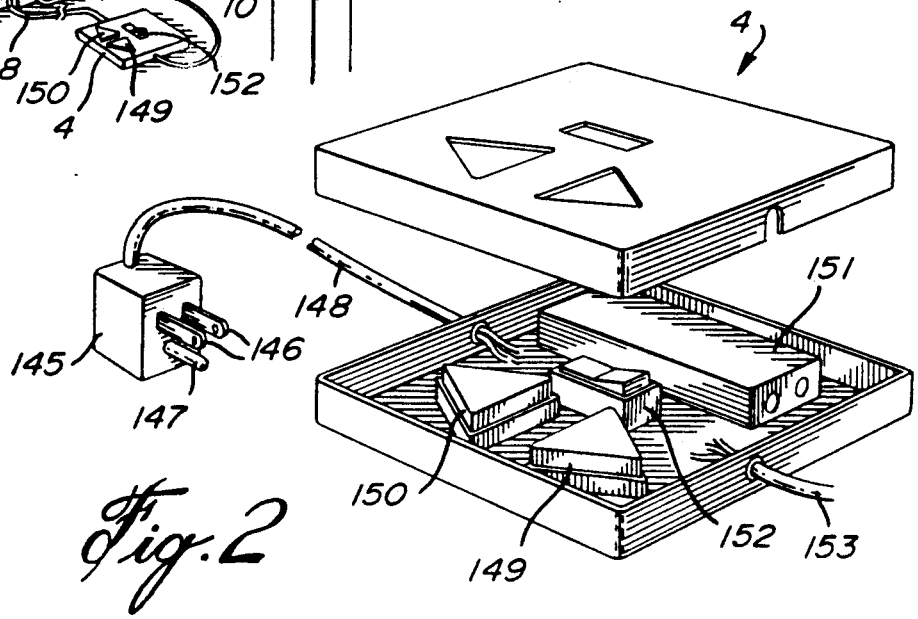
FIG. 2 is a more detailed illustration of the foot control of FIG. 1.

Referring now to the appended drawings, the clothesline in accordance with the invention comprises a cord 1 (FIGS. 1, 3 and 4), a near reel assembly 2 (FIGS. 1 and 3), a distant reel assembly 3 (FIG. 4), and a foot control 4 (FIGS. 1 and 2).

Figure 3:
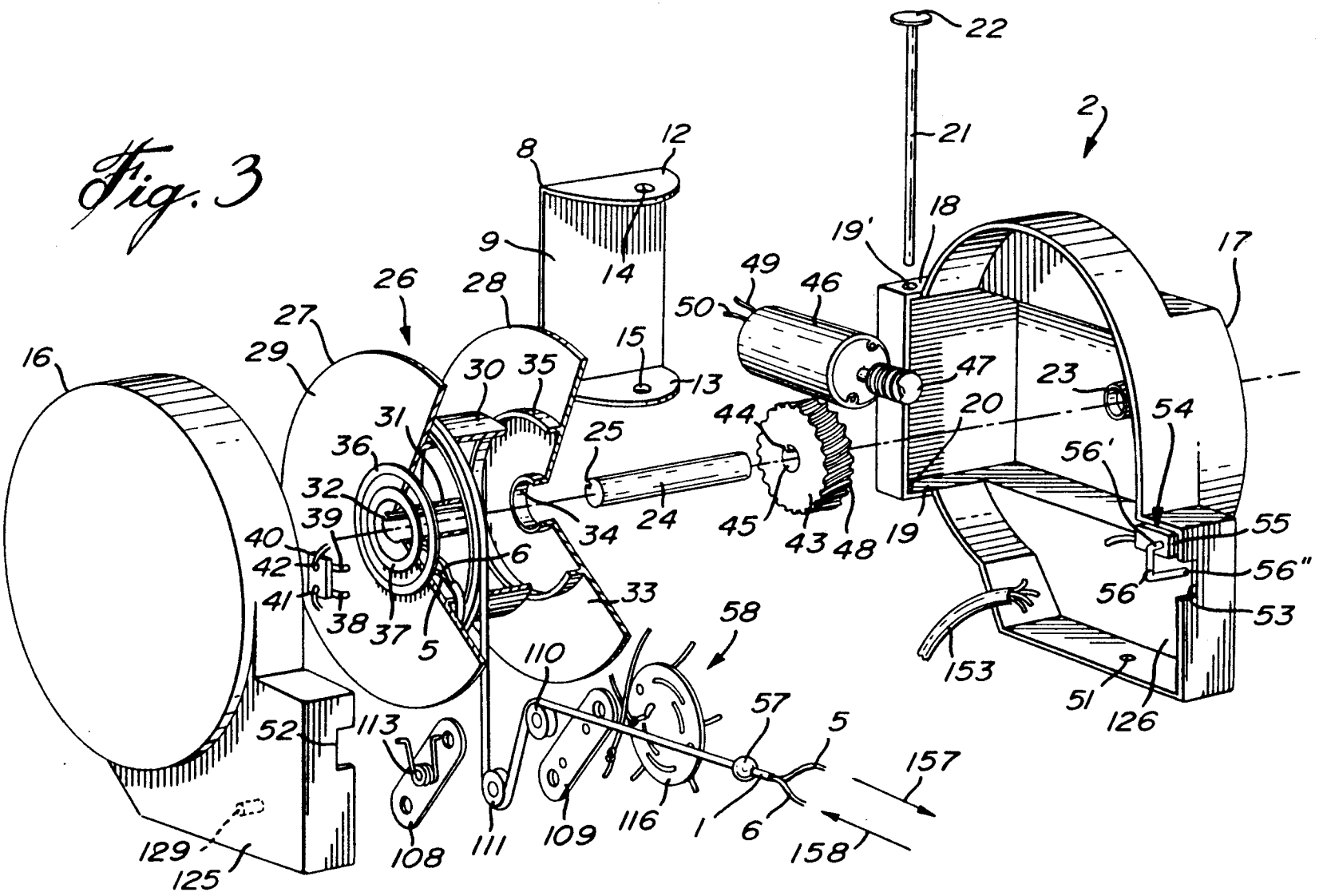
FIG. 3 is a perspective, exploded view of the near reel assembly of the clothesline.
Figure 4:
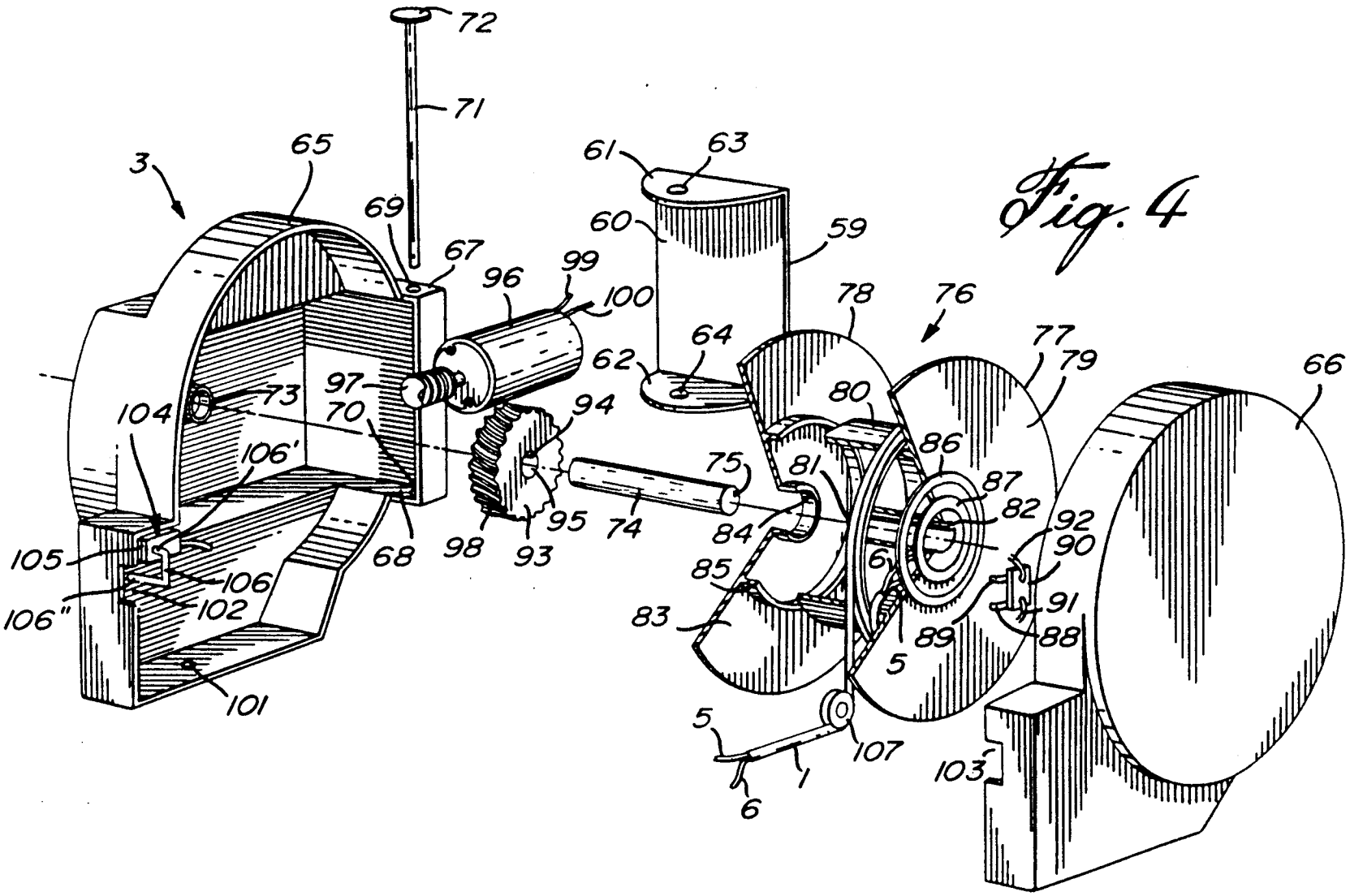
FIG. 4 is a perspective, exploded view of the distant reel assembly of the clothesline.
Figure 6:
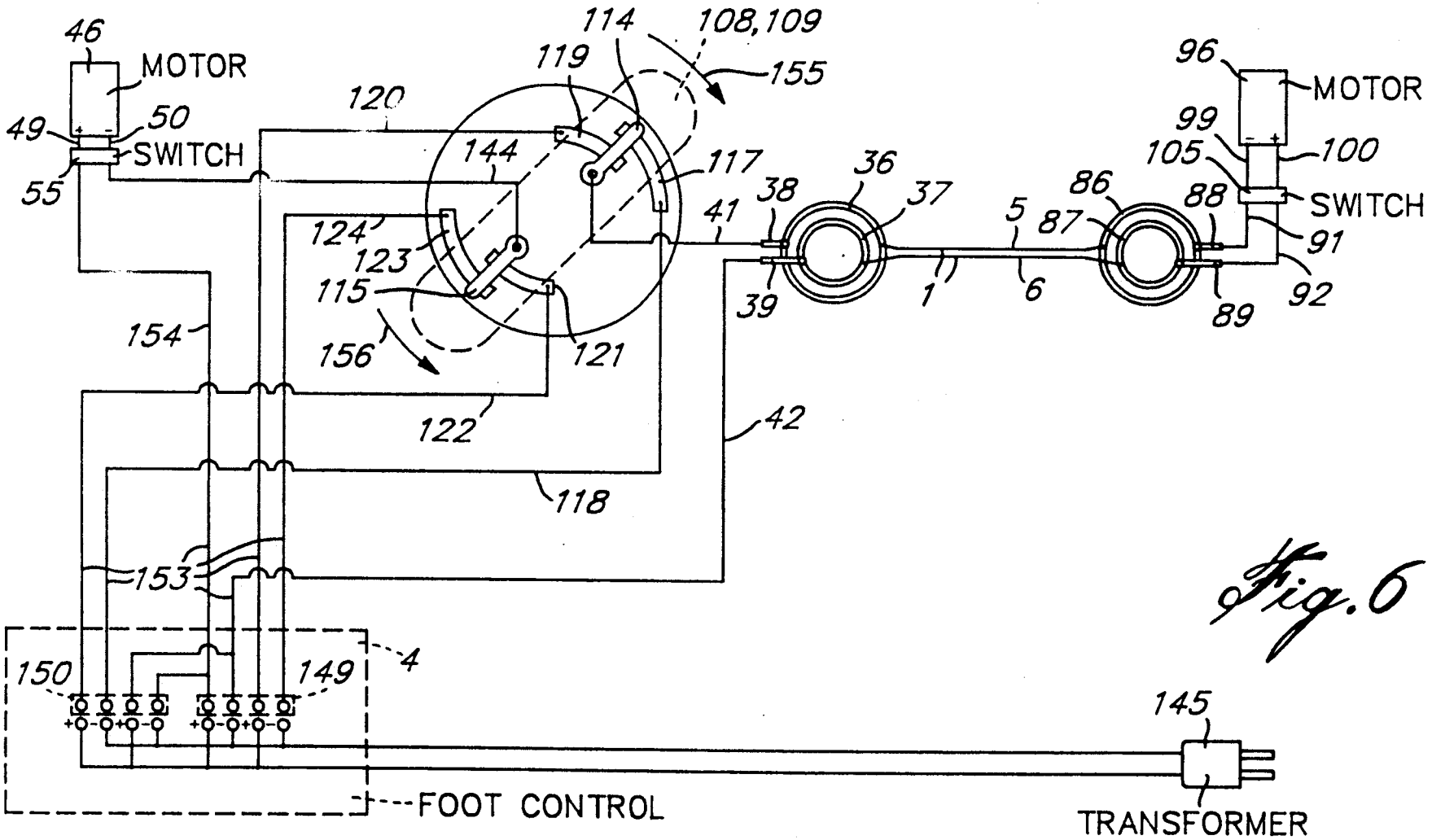
FIG. 6 is a schematic, detailed diagram of the electric circuit of the clothesline.

The cord 1 encloses, as illustrated in FIGS. 3, 4 and 6, a pair of electrically conducting wires 5 and 6. The wires 5 and 6 are obviously individually insulated. The cord 1 further comprises an outer envelope made of electrically insulating plastic material capable of resisting to the sun and to bad weather. The cord 1 is reinforced, for example by means nylon strands enclosed in the plastic envelope, to support the tension therein caused at least in part by the weight of the cord itself and the weight of the clothes such as 7 (FIG. 1) hung thereon.

As illustrated in FIGS. 1 and 3, the near reel assembly 2 comprises a U-shaped bracket 8 having a flat base 9 which can be secured to the outside wall 10 of a house by means of screws such as 11. Obviously, the flat base 9 can be screwed to another clothesline supporting structure such as a post. The bracket 8 also comprises a pair of triangular arms 12 and 13 perpendicular to the base 9 and provided with aligned holes 14 and 15.

The assembly 2 comprises a protective housing formed of two hollow halves 16 and 17 made of molded plastic material. The halves 16 and 17 are removably assembly together by means of suitable fasteners (not shown). The so obtained housing of course protects the inner parts of assembly 2 from the sun, humidity and bad weather.

The half 17 is formed with a rear portion defining upper and lower horizontal walls 18 and 19 comprising respective holes 19' and 20. The half 17 can therefore be attached to the bracket 8 by passing a pin 21 with a head 22 through the holes 14, 19', 20 and 15 and by locking the pin 21 in this position through any suitable means (not shown). The housing can therefore pivot about the vertical, longitudinal axis of the pin 21 for alignment with the cord 1.

The side wall of each plastic half 16 and 17 is formed with an inner cylindrical projection such as 23, a shaft 24 rotating in these two projections. As shown in FIG. 3, the shaft 24 comprises a longitudinal groove 25.

The near assembly 2 further comprises a reel 26 formed of two parts 27 and 28. The reel part 27 is advantageously made of molded plastic material and comprises a circular plate 29, a cylindrical section 30 on which the hear end of the cord 1 is wound, and an central, tubular and cylindrical element 31 slid onto the shaft 24. The inner surface of the tubular element 31 is formed with a longitudinal tongue 32 slid into the groove 25 so that the reel part 27 rotates with the shaft 24. The reel part 28 is also advantageously made of molded plastic material and comprises a circular plate 33 formed with an inner flange 34 positioned around the free end of the tubular element 31, and with an inner and cylindrical projection 35 positioned inside the free end of the cylindrical section 30. The so assembled parts 27 and 28 form, as illustrated in FIG. 3, the reel 26 on which the near end of the cord 1 is wound.

A pair of concentric ring contacts 36 and 37 are fixed on the outer surface of the circular plate 29. As can be seen, these ring contacts are centered on the longitudinal axis of the shaft 24. As the circular plate 29 rotates, electrically conducting metallic strips 38 and 39 slide on the ring contacts 36 and 37, respectively. The latter strips are mounted by means of rivets on an electrically insulating strip holder 40 itself fixedly mounted on the inner surface of the half 16. Electric wires 41 and 42 are respectively connected through the rivets to the strips 38 and 39, while the wires 5 and 6 of the cord 1 are respectively connected to the ring contacts 36 and 37. To that effect, the near end of the cord 1 passes through a hole in the cylindrical section 30 and the wires 5 and 6 traverse the circular plate 29 to reach the ring contacts 36 and 37.

Between the plate 33 and the half 17 is mounted a teethed wheel 43 of a worm gear. The wheel 43 comprises a central hole 45 with a tongue 44. The teethed wheel is mounted on the shaft 24 with its tongue 44 inserted in the groove 25 to set this shaft 24 into rotation.

A 12-volt reversible direct current motor 46 is fixedly mounted inside the half 17 and comprises a rotative threaded shaft 47 engaging the teeth 48 of the wheel 43 to complete the worm gear. When it is supplied with electric current through wires 49 and 50, the motor 46 rotates to drive the reel 26 through the worm gear 43,47 and the rotative shaft 24.

The worm gear presents two advantages: the power and therefore the bulkiness of the electric motor driving the reel can be reduced significantly and the reel is automatically locked in position when the motor in not rotating.

A small hole 51 in the bottom wall of the half 17 allows water to drop out without accumulating. The front walls of the halves 16 and 17 are also cut at 52 and 53, respectively, to form a front opening of the housing through which the cord 1 passes.

A limit switch 54 has a housing 55 secured to the inside of the half 17 and a U-shaped lever 56 with one arm 56' pivotally mounted in the housing 55. The other arm 56" is so positioned as to be actuated by a ball 57 fixed on the cord 1, approximately in the center thereof. As the ball 57, any clothes, a clothes pin or any other physical obstacle present on the cord actuate the arm 56", the motor 46 is deactivated.

The near reel assembly 2 further comprises a system 58 for controlling the tension in the cord 1, which system will be described in detail in the following description.

As will be apparent from the following description, the distant reel assembly 3 illustrated in FIG. 4 is very similar to the near one both in structure and operation.

The distant reel assembly 3 comprises a U-shaped bracket 59 having a flat base 60 which can be secured by means of screws or other fasteners to any clothesline supporting structure such as a post or the outside wall of a house. The bracket 59 also comprises a pair of triangular arms 61 and 62 perpendicular to the base 60 and provided with aligned holes 63 and 64.

The assembly 3 comprises a protective housing formed of two halves 65 and 66 made of molded plastic material. The halves 65 and 66 are removably assembled together by means of suitable fasteners (not shown). The so obtained housing of course protects the inner parts of assembly 3 from the sun, humidity and bad weather.

The half 65 is formed with a rear portion defining upper and lower horizontal walls 67 and 68 comprising respective holes 69 and 70. The half 65 can therefore be attached to the bracket 59 by passing a pin 71 with a head 72 through the holes 63, 69, 70 and 64 and by locking the pin 71 in this position through any suitable means (not shown). The housing can therefore pivot about the vertical, longitudinal axis of the pin 71 for alignment with the cord 1 and the housing of the near reel assembly 2.

The side wall of each plastic half 65 and 66 is formed with an inner cylindrical projection such as 73, a shaft 74 rotating in these two projections. As the shaft 24, the shaft 74 also comprises a longitudinal groove 75.

The distant assembly 3 further comprises a reel 76 formed of two parts 77 and 78. The reel part 77 is advantageously made of molded plastic material and comprises a circular plate 79, a cylindrical section 80 on which the distant end of the cord 1 is wound, and a central, tubular and cylindrical element 81 slid onto the shaft 74. The inner surface of the tubular element 81 is formed with a longitudinal tongue 82 slid into the groove 75 so that the reel part 77 rotates with the shaft 74. The reel part 78 is also advantageously made of molded plastic material and comprises a circular plate 83 formed with an inner flange 84 positioned around the free end of the tubular element 81, and with an inner and cylindrical projection 85 positioned inside the free end of the cylindrical section 80. The so assembled parts 77 and 78 form the reel 76 on which the distant end of the cord 1 is wound.

A pair of concentric ring contacts 86 and 87 are fixed on the outer surface of the circular plate 79. As can be seen, these ring contacts are centered on the longitudinal axis of the shaft 74. As the circular plate 79 rotates, electrically conducting metallic strips 88 and 89 slide on the ring contacts 86 and 87, respectively. The latter strips are mounted by means of rivets on an electrically insulating strip holder 90 itself mounted on the inner surface of the half 66. Electric wires 91 and 92 are respectively connected through the rivets to the strips 88 and 89, while the wires 5 and 6 of the cord 1 are respectively connected to the ring contacts 86 and 87. To that effect, the distant end of the cord 1 passes through a hole in the cylindrical section 80, and the wires 5 and 6 traverse the circular plate 79 to reach the ring contacts 86 and 87.

Between the plate 83 and the half 65 is mounted a teethed wheel 93 of a worm gear. The wheel 93 comprises a central hole 95 with a tongue 94. The teethed wheel is mounted on the shaft 74 with its tongue 94 inserted in the groove 75 to set this shaft 74 into rotation.

A 12-volt reversible direct current motor 96 is fixedly mounted inside the half 65 and comprises a rotative threaded shaft 97 engaging the teeth 98 of the wheel 93 to complete the worm gear. When it is supplied with electric current through wires 99 and 100, the motor 96 rotates to drive the reel 76 through the worm gear 93, 97 and the rotative shaft 74.

A small hole 101 in the bottom wall of the half 65 allows water to drop out without accumulating. The front walls of the halves 65 and 66 are also cut at 102 and 103, respectively, to form a front opening of the housing through which the cord 1 passes. A small pulley 207 aligns the cord 1 with the front opening 102, 103.

A limit switch 104 has a housing 105 secured to the inside of the half 65 and a U-shaped lever 106 with one arm 106' pivotally mounted in the housing 105. The other arm 106" is so positioned as to be actuated by the ball 57 (FIG. 3) fixed on the cord 1, approximately in the center thereof. As the ball 57, any clothes, a clothes pin or any other obstacle present on the cord 1 actuate the arm 106", the motor 96 is deactivated.

As cord 1 is wound and unwound on the reels, their practical diameters change. Therefore, the two reels 26 and 76 are not always winding and unwinding cord 1 at the same rate. This creates slack or too high a tension in the cord.

Figure 5:
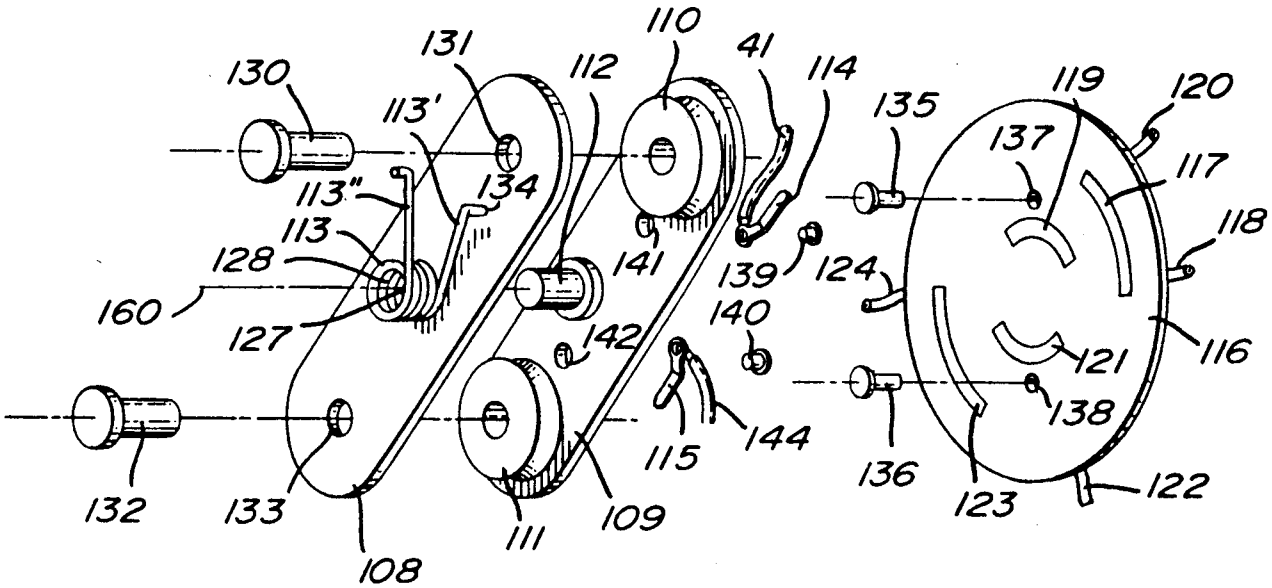
FIG. 5 is a perspective, exploded view of a system for controlling the tension in the cord of the clothesline.

To correct that situation, a system 58, illustrated in FIGS. 3 and 5 is provided to control the tension in the cord 1. This system is mounted between the lateral wall sections 125 and 126 of the housing halves 16 and 17. It comprises a pair of flat arms 108 and 109, a pair of pulleys 110 and 111, a pivot 112, a torsion spring 113, electrically conducting metallic strips 114 and 115, a circular plate 116 made of electrically insulating material, and four semicircular contacts 117, 119, 121 and 123.

The pivot 112 traverses a hole 127 made in the central region of the flat arm 108 and the hole 128 of the torsion spring 113, and has its free end inserted into a cylindrical receptacle 129 (FIG. 3) formed on the inner surface of the wall section 125 whereby the arms 108 and 109 can turn about this pivot 112.

The upper pulley 110 rotates between the flat arms 108 and 109 on a pin 130 traversing a hole 131 in the arm 108 and a corresponding hole (not shown) in the arm 109. In the same manner, the lower pulley 111 rotates between the flat arms 108 and 109 on a pin 132 traversing a hole 133 in the arm 108 and a corresponding hole (not shown) in the arm 109. The pins 130 and 132 are fixed in position by any suitable, conventional means (not shown). As illustrated in FIG. 3, the cord 1 runs under the lower pulley 111 but over the upper one 110.

The torsion spring 113 has a first arm 113' with a perpendicular end inserted into a hole 134 made in the flat arm 108, and a second arm 113" also with a perpendicular end inserted into a hole (not shown) made through the inner surface of the wall section 125 (FIG. 3). As the cord 1 runs under the pulley 111 and over the pulley 110, tension in the cord 1 causes rotation of the arms 108 and 109 about the pivot 112 to thereby twist the spring 113 and produce a torsion force which maintains this tension in the cord 1.

The circular plate 116 is fixed on the inner surface of the wall section 126 of the housing half 17 by means of rivets 135 and 136. Holes 137 and 138 are drilled through the plate 116 for that purpose. The metallic strips 114 and 115 are secured to the outer surface of the flat arm 109 through a pair of rivets 139 and 140 and a pair of holes 141 and 142 made through the arm 109. Upon rotation of the flat arms 108 and 109, the metallic strips 114 and 115 slide onto the semicircular contacts 117, 119, 121 and 123 to establish appropriate electric connections, as will be seen hereinafter. As can be appreciated, the pivot 112 and the semicircular contacts 117, 119 121 and 123 are centered on a common axis 160. Electric wires 41 and 144 are connected to the metallic strips 114 and 115, respectively.

The foot control 4 (FIGS. 1 and 2) comprises a 12-volt plug-in transformer 145. This transformer 145 comprises a pair of metallic blades 146 and a grounding prong 147 connectable into a domestic A.C. outlet inside or outside a house. The transformer 145 is connected to the control 4 through a two-wire cable 148. Obviously, the transformer 145 isolates the domestic A.C. network from the clothesline to prevent accidental electrocution of the user.

The foot control 4 further includes a pair of foot push buttons 149 and 150 for supplying the 12-volt direct current voltage from the transformer 145 to the motors 46 and 96 with a polarity adequate to move the cord longitudinally in the desired direction. THe foot push buttons can obviously be replaced by hand or finger push buttons, or by special devices for disabled persons such as elbow or wrist activated levers.

The foot control 4 also comprises a 12-volt rechargeable battery 151 and a switch 152. In a first position of the switch 152 the battery 151 is charged by the 12-volt direct current voltage, while in the second position of the switch 152 power from the battery 151 is supplied to the motors 46 and 96 in case of power failure.

The foot control 4 is connected to the housing of the near reel assembly 4 through a six-wire cable 153 and obviously comprises itself a housing to protect it from humidity and water infiltration.

Referring now to FIG. 6 of the appended drawings, the operation of the electrically operated clothesline in accordance with the invention will now be described.

When the multi-contact push button 149 of the control 4 is depressed by the foot of the user, the motor 46 is supplied with electric current through the cable 153, the electric wire 154, the limit switch 55, the wires 49 and 50, the wire 144, the metallic strip 115, the semicircular contact 123 and the wire 124, while the motor 96 is supplied through the cable 153, the wire 120, the semicircular contact 119, the metallic strip 114, the wire 41, the metallic strip 38, the circular contact 36, the wire 5, the circular contact 86, the metallic strip 88, the wire 91, the limit switch 105, the wires 99 and 100, the wire 92, the strip 89, the circular contact 87, the wire 6, the contact 37, the strip 39 and the wire 42 (the contacts of the push button 150 are then open). As can be appreciated, the polarity of the direct current supplied to the two reversible motors is so selected that the motor 46 rotates the reel 26 to unwind the cord 1 while the motor 96 rotates the reel 76 to wind the cord 1. The latter cord therefore moves longitudinally in the direction 157 of FIG. 3.

As the reels 26 and 76 rotates, increase of tension in the cord 1 causes rotation of the flat arms 108 and 109 in the direction 155 of FIG. 6. Increase of tension in the cord 1 is caused, as mentioned hereinabove by the two reels 26 and 76 winding and unwinding the cord 1 at different rates due to their change in practical diameter as cord 1 is wound and unwound. As the arms 108 and 109 pivot in the direction 155, the metallic strip 114 slides beyond the end of the contact 119 to deactivate the motor 96. The motor 46 then continues to rotate so that the tension in the cord reduces to turn the arms 108 and 109 back in the direction 156 of FIG. 6 until the motor 96 is reactivated through the contact 119 and the strip 114.

In the same manner, reduction of tension in the cord 1 causes rotation of the arms 108 and 109 in the direction 156 until the metallic strip 115 slides beyond the end of the semicircular contact 123. Reduction of tension in the cord 1 is caused, as mentioned hereinabove by the two reels 26 and 76 winding and unwinding the cord 1 at different rates due to their change in practical diameter as cord 1 is wound and unwound. As strip 115 slides beyond the end of contact 123, the electric motor 46 is deactivated while the motor 96 is still rotating to increase the tension in the cord 1; the arms 108 and 109 then rotate in the direction 155 until the motor 46 is reactivated.

When the multi-contact push button 150 of the control 4 is depressed by the foot of the user, the motor 46 is supplied with electric current through the cable 153, the electric wire 122, the semicircular contact 121, the metallic strip 115, the wire 144, the limit switch 55, the wires 49 and 50, and the wire 154, while the motor 96 is supplied through the cable 153, the wire 42, the metallic strip 39, the circular contact 37, the wire 6, the circular contact 87, the metallic strip 89, the wire 92, the limit switch 105, the wires 99 and 100, the wire 91, the metallic strip 88, the circular contact 86, the wire 5, the circular contact 36, the metallic strip 38, the wire 41, the metallic strip 114, the semicircular contact 117, and the wire 118 (the contacts of the push button 149 are then open). As can be appreciated, the polarity of the current supplying the two reversible motors is so selected that the motor 96 rotates the reel 76 to unwind the cord 1 while the motor 46 rotates the reel 26 to wind the cord 1. This cord 1 then moves longitudinally in the direction 158 of FIG. 3.

As the reels 26 and 76 rotate, increase of tension in the cord 1 causes rotation of the flat arms 108 and 109 in the direction 155. Increase of tension in the cord 1 is caused, as mentioned hereinabove by the two reels 26 and 76 winding and unwinding the cord 1 at different rates due to their change in practical diameter as cord 1 is wound and unwound. As the arms 108 and 109 pivot in the direction 155, the metallic strip 115 slides beyond the end of the contact 121 to deactivate the motor 46. The motor 96 then continues to rotate so that the tension in the cord reduces to turn the arms 108 and 109 back in the direction 156 until the motor 46 is reactivated through the contact 121 and the strip 115.

In the same manner, reduction of tension in the cord 1 causes rotation of the arms 108 and 109 in the direction 156 until the metallic strip 114 slides beyond the end of the semicircular contact 117. Reduction of tension in the cord 1 is caused, as mentioned hereinabove by the two reels 26 and 76 winding and unwinding the cord 1 at different rates due to their change in practical diameter as cord 1 is wound and unwound. AS strip 114 slides beyond the end of contact 117, the electric motor 96 is deactivated while the motor 46 is still rotating to increase the tension in the cord 1; the arms 108 and 109 then rotate in the direction 155 until the motor 96 is reactivated.

The system 58 for controlling the tension in the cord 1 operates as described above each time the tension in the said cord increases or reduces.

If the ball 57 (FIG. 3), any clothes, a clothes pin or any obstacle present on the cord 1 reach the arm 56" or 106" of the limit switch 56 or 106, the corresponding motor 46 or 96 is deactivated through opening of that switch. The other electric motor continues to rotate to reduce the tension in the cord 1 until the system 58 deactivate it as described above. The clothesline is then stopped until the other push button 149 or 150 is depressed. Overwinding of the cord is accordingly prevented.

Although the present invention has been described hereinabove by way of a preferred embodiment thereof, such an embodiment can be modified at will, within the scope of the appended claims, without departing from the spirit and nature of the subject invention. For example, the system 58 can be replaced by an extension spring mounted between the housing of the near reel assembly 2 and the outside wall 10 of the house, too high or too low a tension in the cord 1 being detected by extension or compression of that spring to open contacts and shut one motor off when needed. The tension controlling system 58 can eventually be replaced by another technical equivalent including a brake system installed in each reel assembly 26, 76 for reducing the speed of the motor unwinding cord 1 to thereby maintain an adequate tension in the latter cord. Obviously, the worn gears should then be replaced by another type of gearing. Also, the semicircular contacts 117, 119, 121 and 123 can be replaced by flat dimmers to slow down one motor and speed up the other when required. Furthermore, the push buttons 149 and 150 can be replaced by speed control potentiometers allowing the user to control the linear speed of the cord 1.

What is claimed is:

1. An electrically operated clothesline comprising:

a single cord on which clothes can be hung, said cord having first and second ends and enclosing individually insulated electric wires;

a near reel assembly attachable to a first clothesline supporting structure and comprising (a) a first reel on which said first end of the cord is wound, and (b) a first reversible electric motor for driving the said first reel;

a distant reel assembly attachable to a second clothesline supporting structure and comprising (a) a second reel on which said second end of the cord is wound, and (b) a second reversible electric motor for driving the said second reel; and supply means for supplying the first and second reversible motors with electric current to move the said cord longitudinally in either direction, said second motor being supplied with electric current through the wires enclosed in the cord.

2. An electrically operated clothesline as recited in claim 1, in which the said supply means comprises means for controlling a tension in the said cord.

3. An electrically operated clothesline as recited in claim 2, in which said tension controlling means comprises means for momentarily interrupting the electric current supplying one of the electric motors.

4. An electrically operated clothesline as recited in claim 2, in which the said tension controlling means comprises:

a stationary, electrically insulating circular plate;

a plurality of semicircular contacts mounted on said stationary plate and centered on a common axis perpendicular to the said plate;

an arm structure rotatable about said common axis;

a torsion spring for producing a torsion force on the arm structure upon rotation of said arm structure;

a pair of pulleys mounted on the said arm structure, said cord being run on said pulleys to rotate the arm structure about said common axis in function of the tension in said cord; and a plurality of contacts fixedly mounted on the rotatable arm structure and sliding on the semicircular contacts to establish and interrupt electric connections through which electric current is supplied to the two reversible motors.

5. An electrically operated clothesline as recited in claim 1, wherein the first electric motor drives the first reel through a first worm gear, and the second electric motor drives the second reel through a second worm gear.

6. An electrically operated clothesline as recited in claim 1, wherein the first and second reels each rotate about a generally horizontal axis, and wherein the near and distant reel assemblies are respectively rotatable on the first and second clothesline supporting structures about a generally vertical axis.

7. An electrically operated clothesline as recited in claim 1, wherein the said near and distant reel assemblies each comprise a limit switch actuatable by a physical obstacle present on the cord for deactivating the first and second motors, respectively.

8. An electrically operated clothesline as recited in claim 7, in which a ball is fixedly mounted on the said cord to actuate the said limit switches.

9. An electrically operated clothesline as recited in claim 1, in which the said supply means comprises control means including (a) a first push button depressed to move the cord longitudinally in a first direction, and (b) a second push button depressed to move the cord longitudinally in a second direction.

10. An electrically operated clothesline as recited in claim 9, wherein the said control means is a foot control.

11. An electrically operated clothesline as recited in claim 1, in which the said supply means comprises (a) first switching means which can be actuated to move the cord longitudinally in a first direction, and (b) second switching means which can be actuated to move the cord longitudinally in a second direction.

* * * * *